United States Patent [19]

Hawkes et al.

[11] 4,102,530

[45] Jul. 25, 1978

[54] ROTATING FURNACES

[75] Inventors: David A. Hawkes, Guisborough; Alan L. Robson, Middlesbrough; Andray Uemlianin, Redcar, all of England

[73] Assignee: British Steel Corporation, London, England

[21] Appl. No.: 814,473

[22] Filed: Jul. 11, 1977

[30] Foreign Application Priority Data

Jul. 16, 1976 [GB] United Kingdom ..... 29778/76

[51] Int. Cl.[2] ..... C21B 7/10

[52] U.S. Cl. ..... 266/46; 266/241; 432/116

[58] Field of Search ..... 266/44, 46, 190, 191, 266/192, 193, 194, 204, 241, 248; 432/4, 77, 83, 116

[56] References Cited

U.S. PATENT DOCUMENTS 3,510,115 5/1970 Foex et al. ..... 266/241 X

FOREIGN PATENT DOCUMENTS 570,311 2/1959 Fed. Rep. of Germany ..... 432/116

256,158 7/1926 United Kingdom ..... 432/116

*Primary Examiner*—Roy Lake

*Assistant Examiner*—Paul A. Bell

*Attorney, Agent, or Firm*—Bacon & Thomas

[57] ABSTRACT

A rotatable horizontal metallurgical furnace for the production of iron or steel includes cooling means at an open discharge end of the furnace. The cooling means includes an annular cooling coil surrounding the discharge end through which cooling liquid is continuously impelled, under centrifugal forces of rotation, from an annular delivery trough to an annular collecting trough.

8 Claims, 1 Drawing Figure

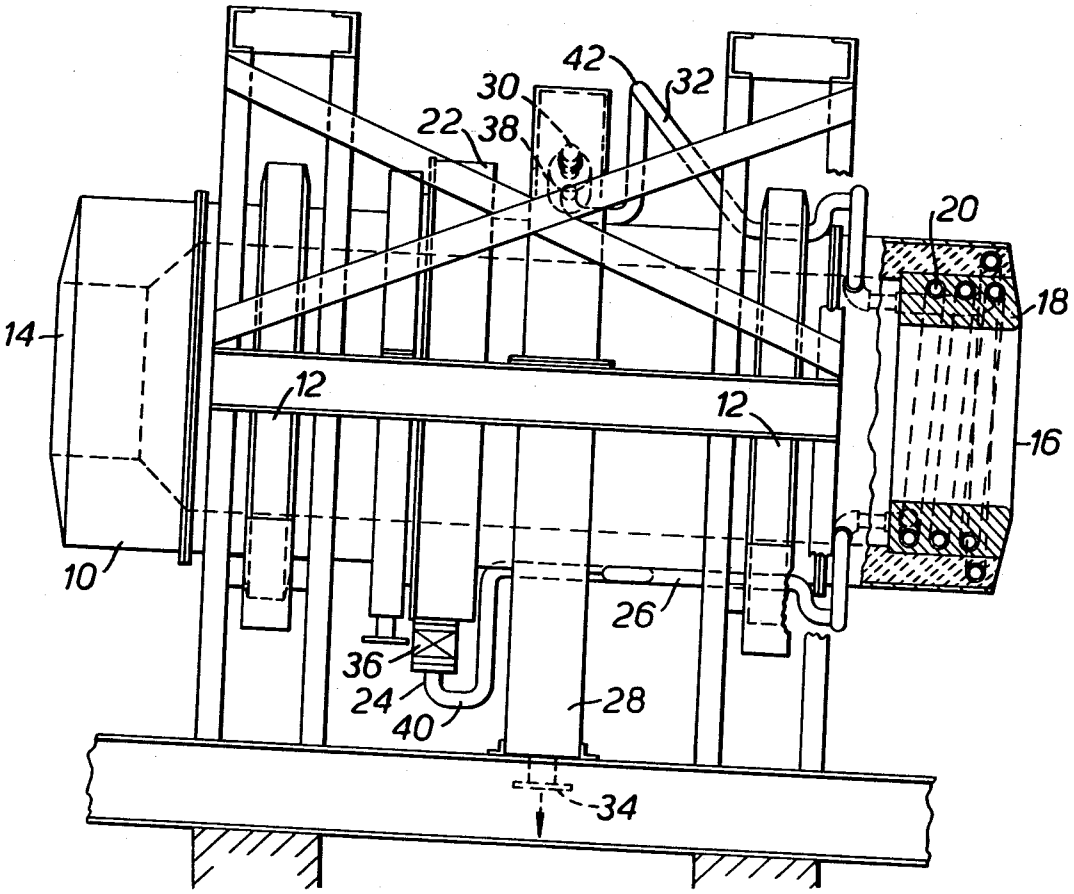
18
16
20
12
32
42
30
38
22
26
28
34
40
24
36
12
10
14

ROTATING FURNACES

This invention relates to the cooling of rotating furnaces, and in particular to the cooling of high speed rotating metallurgical furnaces for the production of iron or steel.

In accepted U.S. Pat. No. 3,814,596 and in an article by Eketorp in "Steel Times," Mar. 17, 1967, there are described continuous processes for the production of iron or steel in rotating horizontally-disposed furnaces. In these processes the furnace is rotated at a speed sufficiently high to ensure that the liquid and solid contents of the furnace are maintained around the internal wall of the furnace by centrifugal force.

It is a broad object of the present invention to provide improved means for cooling the discharge end of a rotating furnace. A more particular object of the invention is to provide means for cooling an end dam within the lining of the furnace at the discharge end which dam functions to retain the vessel contents, except during the period of casting thereof. Such an end dam is extremely susceptible to corrosive attack by the slag contents of the furnace.

In accordance with one aspect of the invention there is provided a furnace of generally cylindrical form rotatable about its longitudinal axis having a charging end and a discharge end and cooling means at its discharge end comprising an annular cooling coil surrounding the discharge end, an annular first trough surrounding the furnace and rotatable therewith adapted to receive a continuous supply of cooling liquid and a stationary annular second trough surrounding the furnace; the cooling coil connecting at an inlet end thereof with the first trough and at an outlet end thereof with the second trough whereby, under centrifugal forces of rotation, cooling liquid is impelled from the first trough continuously through the coil to discharge into the second trough.

In accordance with another aspect of the invention there is provided a method of treating material in a rotating generally cylindrical furnace having a charging end and a discharge end including the steps of supplying a cooling liquid to cool the discharge end by continuously passing said liquid through an annular coil at the discharge end, said liquid being delivered at an inlet end of the coil from an annular first trough surrounding the furnace and rotatable therewith to which the cooling liquid is supplied continuously and being impelled through the coil under centrifugal forces of rotation to discharge from an outlet end of the coil into a stationary annular second trough surrounding the furnace.

The cooling coil is located to cool an end dam within the discharge end of the furnace. Such a dam may be of a refractory material or a heat conducting material such as copper or steel and the cooling coil is conveniently embedded within the material of the dam.

Other features of the invention will become apparent from the following description given herein solely by way of example with reference to the accompanying drawing which shows a side cross-sectional view through a rotatable cylindrical metallurgical furnace.

As shown in the drawing a rotatable metallurgical furnace of generally cylindrical form comprises a refractory lined steel drum 10 mounted for rotation about its longitudinal axis and being generally horizontally disposed, that is to say at an angle of between 0° and 8° to the horizontal. The drum is supported by peripheral tyres on rollers (not shown) one or more of which is driven by a motor to rotate the furnace.

The furnace is provided with an upper charging end 14 and a lower discharge end 16. Into the charging end 14 are fed iron or steelmaking materials whilst liquid metal and slag are discharged from the discharge end 16 into a stationary refractory lined hood (not shown).

Within the furnace at the discharge end thereof there is provided an end dam 18 manufactured of a heat conducting material, for example, copper or steel and within which is located an annular multi-turn coil 20 of tubular metal through which may pass a cooling liquid in a manner which will be further described herein. When the end dam 18 is cooled during operation of the furnace a layer of slag will freeze on the radially inner surface of the dam and effecitvely form part thereof. Such frozen slag will during operation of the furnace reach an optimum thickness and any further slag flowing on to the dam would remain fluid and will be cast out of the discharge end of the furnace; thus no contact between the corrosive liquid slag and the end dam material will occur.

Cooling liquid is supplied to the annular cooling coil 20 from an annular supply trough 22 surrounding the furnace and rotatable therewith. An input end 24 of the cooling coil 20 is connected by appropriate pipework 26 to communicate with the radially outer base of the supply trough 22 to which cooling liquid is continuously supplied from an appropriate mains source.

An annular collecting trough 28 is fixedly mounted to surround the rotating furnace and a discharge nozzle 30 of the cooling coil 20 communicates with the collecting trough 28 by appropriate pipework 32 and is so arranged that the actual discharge nozzle 30 can rotate within the trough 28. A drain 34 is provided at the lowermost position of this trough 28 for discharging used cooling liquid to waste.

As will be seen from the drawing there is a difference in the radial distance from the centre line of the furnace between the level of liquid which can be established in the rotating supply trough 22 and the outlet nozzle 30 of the cooling coil where it discharges into the stationary trough 28 whereby the liquid at the outlet nozzle 30 is subjected to a higher '*g*' force than the liquid in the supply trough 22. Thus the liquid inside the supply trough 22 will be impelled by syphonic action through the pipework 26–32 and the cooling coil 20 and out through the nozzle 30 and, providing that the supply trough 22 is not drained of liquid and the furnace continues to spin at an acceptable speed, then a difference in '*g*' force will exist between the inlet and outlet positions and the cooling liquid will continue to flow through the system.

To commence flow of liquid through the pipework it is necessary for the entire cooling system to be primed by being filled with cooling liquid. The liquid is then held inside the pipework by manually closing an inlet valve 36 positioned where the input pipework 26 communicates with the supply trough 22 and an outlet valve 38 in the pipework 32 at the outlet nozzle 30 where it communicates with the collecting trough 28. The furnace is then rotated at a speed which will allow a full reservoir of water to be established in the supply trough 22 and the drum speed is increased until the inlet valve 36 in the trough 22 opens at a pre-determined '*g*' force. The drum speed is then further increased until the outlet valve 38 opens at a pre-determined '*g*' value which is higher than that for valve 36, at which time cooling liquid will flow continuously through the system. It will be noted that the loops 40–42 in the respective communicating pipework 26–32 between the actual cooling coil 20 and the supply and collecting troughs 22–28 are of such radial dimensions as to prevent back-syphoning and subsequent draining of the system should the liquid flow into the supply trough be interrupted for any reason.

We claim:

1. A method of treating material in a rotating generally cylindrical furnace having a charging end and a discharge end including the steps of supplying a cooling liquid to cool the discharge end by continuously passing said liquid through an annular coil at the discharge end, said liquid being delivered at an inlet end of the coil from an annular first trough surrounding the furnace and rotatable therewith to which the cooling liquid is supplied continuously and being impelled through the coil under centrifugal forces of rotation to discharge from an outlet end of the coil into a stationary annular second trough surrounding the furnace.

2. A method according to claim 1 wherein iron or steel-making materials are treated within the furnace.

3. A furnace of generally cylindrical form rotatable about its longitudinal axis having a charging end and a discharge end and cooling means at its discharge end comprising an annular cooling coil surrounding the discharge end, an annular first trough surrounding the furnace and rotatable therewith adapted to receive a continuous supply of cooling liquid and a stationary annular second trough surrounding the furnace; the cooling coil connecting at an inlet end thereof with the first trough and at an outlet end thereof with the second trough whereby, under centrifugal forces of rotation, cooling liquid is impelled from the first trough continuously through the coil to discharge into the second trough.

4. A furnace as claimed in claim 3 wherein an annular dam is provided at the discharge end of the furnace and said cooling coil is embedded within the dam.

5. A furnace as claimed in claim 4 wherein the dam is formed of a metallic material.

6. A furnace as claimed in claim 4 wherein the dam is formed of a refractory material.

7. A furnace as claimed in claim 3 wherein inlet and outlet valves are provided to the respective inlet and outlet ends of the cooling coil, said valves being responsive to centrifugal forces to open at a predetermined value; the valve to the outlet side of the coil being set to open at a higher value than the valve to the inlet side.

8. A furnace as claimed in claim 3 which is a metallurgical furnace for the production of iron or steel.

* * * * *